US009254697B2

(12) United States Patent
Yanagishita

(10) Patent No.: US 9,254,697 B2
(45) Date of Patent: Feb. 9, 2016

(54) RECORDING APPARATUS, MAINTENANCE METHOD AND RECORDING METHOD OF RECORDING APPARATUS

(71) Applicant: SEIKO EPSON CORPORATION, Tokyo (JP)

(72) Inventor: Kenji Yanagishita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/669,921

(22) Filed: Mar. 26, 2015

(65) Prior Publication Data

US 2015/0197109 A1 Jul. 16, 2015

Related U.S. Application Data

(63) Continuation of application No. 14/084,477, filed on Nov. 19, 2013, now Pat. No. 9,022,513.

(30) Foreign Application Priority Data

Nov. 21, 2012 (JP) ..... 2012-255008

(51) Int. Cl.
*B41J 29/38* (2006.01)
*B41J 13/10* (2006.01)
*B41J 2/165* (2006.01)

(52) U.S. Cl.
CPC ..... *B41J 13/10* (2013.01); *B41J 2/16544* (2013.01); *B41J 13/103* (2013.01); *B41J 2002/1655* (2013.01)

(58) Field of Classification Search
CPC ..... B41J 13/103; B41J 2002/1655; B41J 2/16544; B41J 2002/1742
USPC ..... 347/16, 22, 23, 37, 101, 104; 271/3.78, 271/10.12
See application file for complete search history.

(56) References Cited

U.S. PATENT DOCUMENTS

| | | | | |
|---|---|---|---|---|
| 8,100,492 | B2 | 1/2012 | Mitsuhashi et al. | |
| 8,286,960 | B2 | 10/2012 | Teshigawara et al. | |
| 9,022,513 | B2 * | 5/2015 | Yanagishita | 347/16 |
| 2012/0162302 | A1 | 6/2012 | Oguchi et al. | |

FOREIGN PATENT DOCUMENTS

JP 2006-035658 2/2006

OTHER PUBLICATIONS

U.S. Appl. No. 14/084,477, Sep. 22, 2014, Office Action.
U.S. Appl. No. 14/084,477, Jan. 22, 2015, Notice of Allowance.

* cited by examiner

*Primary Examiner* — An Do
(74) *Attorney, Agent, or Firm* — Workman Nydegger

(57) ABSTRACT

A recording apparatus including: a medium support tray capable of supporting a recording medium; a moving mechanism moving the medium support tray; a recording head capable of recording on the recording medium which is transported by moving the medium support tray; a protective member of the recording head; an instruction receiving section which receives an instruction of a maintenance start of the protective member; and a controller which controls the moving mechanism so as to retract the medium support tray from a set position in which the recording medium is set on the medium support tray when the instruction receiving section receives the instruction of the maintenance start.

6 Claims, 12 Drawing Sheets

RECORDING APPARATUS, MAINTENANCE METHOD AND RECORDING METHOD OF RECORDING APPARATUS

CROSS-REFERENCE TO RELATED APPLICATIONS

This application is a continuation application of U.S. patent application Ser. No. 14/084,477, filed Nov. 19, 2013, now U.S. Pat. No. 9,022,513, which patent application is incorporated herein by reference in its entirety. U.S. patent application Ser. No. 14/084,477 claims the benefit of and priority to Japanese Patent Application No. 2012-255008 filed Nov. 21, 2012, the contents of which are hereby incorporated by reference in its entirety.

BACKGROUND

1. Technical Field

The present invention relates to a recording apparatus, a maintenance method and a recording method of the recording apparatus.

2. Related Art

In the related art, a recording apparatus is used which includes a medium support tray capable of supporting a recording medium and a moving mechanism of the medium support tray, and records on a recording medium which is transported by moving the medium support tray using a moving mechanism. Such a recording apparatus has a cap, a wiper or the like as a protective member for maintaining a function of a recording head as a recording section.

For example, a recording apparatus is disclosed in JP-A-2006-35658, which includes a wiper (wiper blade) as a protective member for maintaining a function of a recording head (for performing recovery of ejection of a recording head) and a wiper maintenance unit for removing ink adhered to the wiper.

Since the ink or the like is adhered to such a protective member of the recording head in accordance with the use of the recording apparatus, maintenance such as cleaning may be required. Generally, the maintenance of the protective member of the recording head is performed manually by a user using a dedicated maintenance kit.

However, in the recording apparatus which performs recording on the recording medium which is transported by moving the medium support tray using the moving mechanism, the medium support tray is an obstacle and efficiency of a maintenance work may be lowered, when performing the maintenance. Especially, in such a recording apparatus, in order to increase efficiency of a setting operation, generally, a set position is in the front side of a main body of the recording apparatus when setting the recording medium on the medium support tray. Therefore, the medium support tray is an obstacle because of being positioned in the set position.

Regarding the recording apparatus of JP-A-2006-35658, there is no description about a position of a platen that is the medium support tray when performing the maintenance. That is, in the recording apparatus of JP-A-2006-35658, the position of the platen is not clear when performing the maintenance and the efficiency of the maintenance work may be lowered when performing the maintenance of the protective member of the recording head.

As described above, in the recording apparatus of the related art, the position of the medium support tray is not controlled when performing the maintenance and the efficiency of the maintenance work may be lowered when performing the maintenance of the protective member of the recording head.

SUMMARY

An advantage of some aspects of the invention is to suppress efficiency of a maintenance work from being lowered when performing maintenance of a protective member of a recording head.

According to an aspect of the invention, there is provided a recording apparatus which includes: a medium support tray capable of supporting a recording medium; a moving mechanism of the medium support tray; a recording head capable of recording on the recording medium which is transported by moving the medium support tray using the moving mechanism; a protective member for maintaining a function of the recording head; a receiving section of an instruction of a maintenance start, which receives the instruction of the maintenance start of the protective member; and a controller which controls the moving mechanism so as to retract the medium support tray from a set position when setting the recording medium on the medium support tray in response to the receiving of the instruction of the maintenance start in the receiving section of the instruction of the maintenance start.

Here, for example, "the protective member for maintaining the function of the recording head" means a cap for suppressing ink from adhering on an ejection port of the recording head or a wiper for cleaning the recording head, and means all members which are intended to maintain the function of the recording head. "Receiving the instruction of the maintenance start of the protective member" means to receive a signal for performing a maintenance sequence such as a cleaning sequence of the protective member such as the cap or the wiper. "Maintenance" also includes exchange of the protective member or the like in addition to the cleaning.

In this case, the medium support tray is retracted from the set position in response to the receiving of the instruction of the maintenance start. Thus, it is possible to suppress efficiency of the maintenance work from being lowered when performing the maintenance of the protective member of the recording head.

It is preferable that the controller control the moving mechanism so as to move the medium support tray to the outside of a recordable area of the recording head.

In this case, since the medium support tray is moved to the outside of the recordable area of the recording head when performing the maintenance of the recording head or the protective member, it is possible to suppress the recording head from coming in contact with the medium support tray and it is possible to suppress the efficiency of the maintenance work from being lowered.

It is preferable that the recording apparatus further include: a recording head moving mechanism capable of reciprocating the recording head in an intersecting direction intersecting a moving direction of the medium support tray using the moving mechanism, in which the controller controls the recording head moving mechanism so as to move the recording head from a target area of the maintenance when the medium support tray is retracted using the moving mechanism.

In this case, since the recording head is retracted from the target area of the maintenance in the protective member when a user starts the maintenance, it is possible to immediately start the maintenance work.

"Target area of the maintenance" includes an area in which a presence of the recording head is an obstacle when the user performs the maintenance work, and includes the vicinity of the protective member which is a target of the maintenance.

It is preferable that the controller control the recording head moving mechanism so as to move the recording head from the target area of the maintenance following the retraction of the medium support tray using the moving mechanism.

In this case, the retraction of the medium support tray is completed when moving the recording head. Thus, when moving the recording head to a retracted position, it is possible to suppress the recording head from coming in contact with the medium support tray or the recording medium supported on the medium support tray or to suppress an ink from dropping from the recording head to the recording medium.

It is preferable that the controller determine whether or not the recording medium is supported on the medium support tray, and control the moving mechanism so as to retract the medium support tray from the set position to a recording start position when it is determined that the recording medium is supported.

In this case, the medium support tray is retracted from the set position to the recording start position when it is determined that the recording medium is supported. Thus, it is possible to start the recording immediately after the maintenance is completed.

It is preferable that the controller control the moving mechanism so as to retract the medium support tray to the outside of the recordable area when it is determined that the recording medium is not supported.

It is preferable that the recording apparatus further include a receiving section of an instruction of a maintenance completion, which receives the instruction of the maintenance completion of the protective member, in which the controller determines the presence or absence of the instruction of the recording and determines whether or not the recording medium is supported on the medium support tray in response to the receiving of the instruction of the maintenance completion in the receiving section of the instruction of the maintenance completion, and controls the recording apparatus so as to start the recording when it is determined that the instruction of the recording is present and it is determined that the recording medium is supported, and controls the moving mechanism so as to move the medium support tray to the set position when it is determined that the instruction of the recording is present and it is determined that the recording medium is not supported.

Here, "receiving the instruction of the maintenance completion of the protective member" means to receive a signal indicating that the maintenance sequence or the like of the protective member is completed. For example, a configuration may be used in which the user transmits the signal indicating that the cleaning is completed through the control panel and the signal is received, after the maintenance of cleaning the cap is completed. A configuration may be used in which the signal indicating that the cleaning is completed is transmitted, the interlocking with close of the main body cover provided in the main body of the recording apparatus by the user and the signal is received, after the cleaning of the cap is completed.

"Instruction of the recording" means an input of the recording data into the recording apparatus.

In this case, the controller determines the presence or absence of the instruction of the recording and whether or not the recording medium is supported on the medium support tray in response to the receiving of the instruction of the maintenance completion. The controller controls the recording apparatus so as to start the recording when it is determined that the instruction of the recording is present and it is determined that the recording medium is supported. The controller controls the moving mechanism so as to move the medium support tray to the set position when it is determined that the instruction of the recording is present and it is determined that the recording medium is not supported. Thus, it is possible to start the recording with the recording apparatus immediately after the maintenance is completed, when it is determined that the instruction of the recording is present and it is determined that the recording medium is supported. It is possible to set the recording medium on the medium support tray immediately after the maintenance is completed and it is possible to start the recording with the recording apparatus immediately thereafter, when it is determined that the instruction of the recording is present and it is determined that the recording medium is not supported.

The medium support tray may be moved or may not be moved to the set position or the like when it is determined that the instruction of the recording is absent.

It is preferable that the moving mechanism have a cover interlocking with the moving of the medium support tray.

In this case, the moving mechanism has the cover interlocking with the moving of the medium support tray. Thus, the cover can protect the inside of the moving mechanism even though the medium support tray is moved to any position.

According to another aspect of the invention, there is provided a maintenance method of a recording apparatus having: a medium support tray capable of supporting a recording medium; a moving mechanism of the medium support tray; a recording head capable of recording on the recording medium which is transported by moving the medium support tray using the moving mechanism; and a protective member for maintaining a function of the recording head, which includes: receiving an instruction of the maintenance start of the protective member; and controlling the moving mechanism so as to retract the medium support tray from a set position when the recording medium is set on the medium support tray.

In this case, the medium support tray is retracted from the set position in response to the receiving of the instruction of the maintenance start. Thus, it is possible to suppress the efficiency of the maintenance work from being lowered when performing the maintenance of the protective member of the recording head.

It is preferable that the maintenance method of a recording apparatus further having: a recording head moving mechanism capable of reciprocating the recording head in an intersecting direction intersecting a moving direction of the medium support tray using the moving mechanism further include controlling the recording head moving mechanism so as to move the recording head from an target area of the maintenance following retraction of the medium support tray using the moving mechanism.

In this case, the recording head is moved from the target area of the maintenance following the retraction of the medium support tray. That is, the retraction of the medium support tray is completed when moving the recording head. Thus, when moving the recording head to the retracted position, it is possible to suppress the recording head from coming in contact with the medium support tray or the recording medium supported on the medium support tray, or to suppress an ink from dropping from the recording head to the recording medium.

It is preferable that the maintenance method further include: determining whether or not the recording medium is supported on the medium support tray, after receiving the instruction of the maintenance start; controlling the moving mechanism so as to retract the medium support tray from the set position to the recording start position when it is determined that the recording medium is supported; and controlling the moving mechanism so as to retract the medium support tray from the set position to the outside of the recordable area of the recording head when it is determined that the recording medium is not supported.

In this case, the medium support tray is retracted from the set position to the recording start position when it is detected that the recording medium is supported. Thus, it is possible to start the recording immediately after the maintenance is completed.

The medium support tray is retracted from the set position to the outside of the recordable area of the recording head when it is determined that the recording medium is not supported. Thus, since the medium support tray is moved to the outside of the recordable area of the recording head when performing the maintenance of the recording head or the protective member, it is possible to suppress the recording head from coming in contact with the medium support tray and it is possible to suppress the efficiency of the maintenance work from being lowered.

According to still another aspect of the invention, there is provided a recording method of a recording apparatus having: a medium support tray capable of supporting a recording medium; a moving mechanism of the medium support tray; a recording head capable of recording on the recording medium which is transported by moving the medium support tray using the moving mechanism; and a protective member for maintaining a function of the recording head, which includes: receiving an instruction of the maintenance start of the protective member; retracting the medium support tray from a set position when setting the recording medium on the medium support tray; receiving an instruction of the maintenance completion of the protective member; determining presence or absence of an instruction of the recording and whether or not the recording medium is supported on the medium support tray; controlling the recording apparatus so as to start a recording when it is determined that the instruction of the recording is present and it is determined that the recording medium is supported; and controlling the moving mechanism so as to move the medium support tray to the set position when it is determined that the instruction of the recording is present and it is determined that the recording medium is not supported.

In this case, the presence or absence of the instruction of the recording and whether or not the recording medium is supported on the medium support tray is determined in response to the receiving of the instruction of the maintenance completion. The recording apparatus is controlled so as to start the recording when it is determined that the instruction of the recording is present and it is determined that the recording medium is supported. The moving mechanism is controlled so as to move the medium support tray to the set position when it is determined that the instruction of the recording is present and it is determined that the recording medium is not supported. Thus, it is possible to start the recording with the recording apparatus immediately after the maintenance is completed, when it is determined that the instruction of the recording is present and it is determined that the recording medium is supported. It is possible to set the recording medium on the medium support tray immediately after the maintenance is completed and it is possible to start the recording with the recording apparatus immediately thereafter, when it is determined that the instruction of the recording is present and it is determined that the recording medium is not supported.

The medium support tray may be moved or may not be moved to the set position or the like, when it is determined that the instruction of the recording is absent.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment of Recording Apparatus (FIGS. 1 to 9)

Hereinafter, a recording apparatus according to an embodiment of the invention will be described in detail with reference to attached drawings.

First, the recording apparatus according to the embodiment of the invention will be described.

Figure 1:
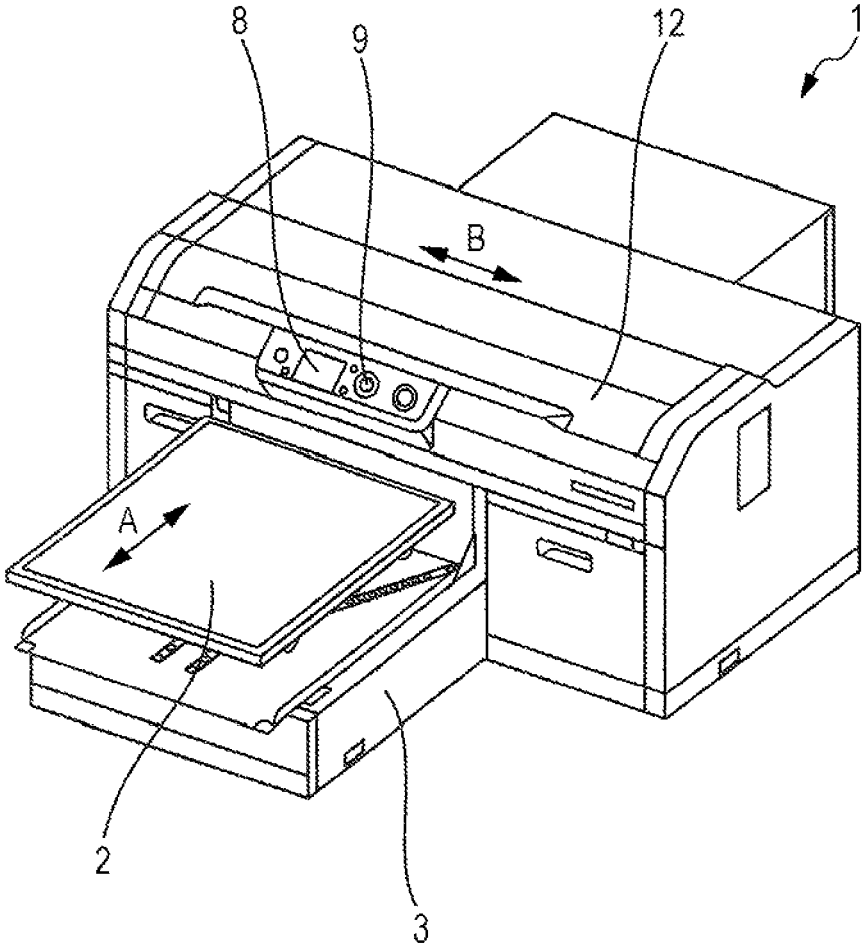
FIG. 1 is a schematic perspective view illustrating a state where a medium support tray is in a set position of a recording medium in a recording apparatus according to an embodiment of the invention.
Figure 2:
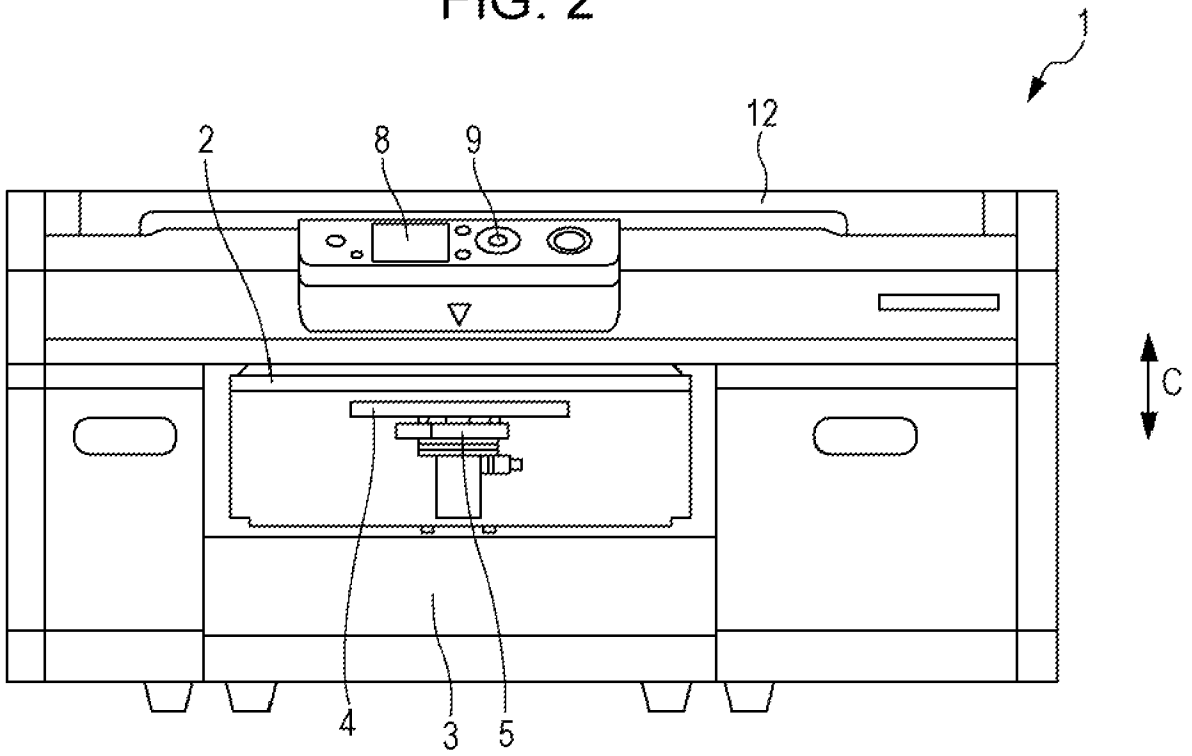
FIG. 2 is a schematic front view illustrating the state where the medium support tray is in the set position of the recording medium in the recording apparatus according to the embodiment of the invention.
Figure 3:
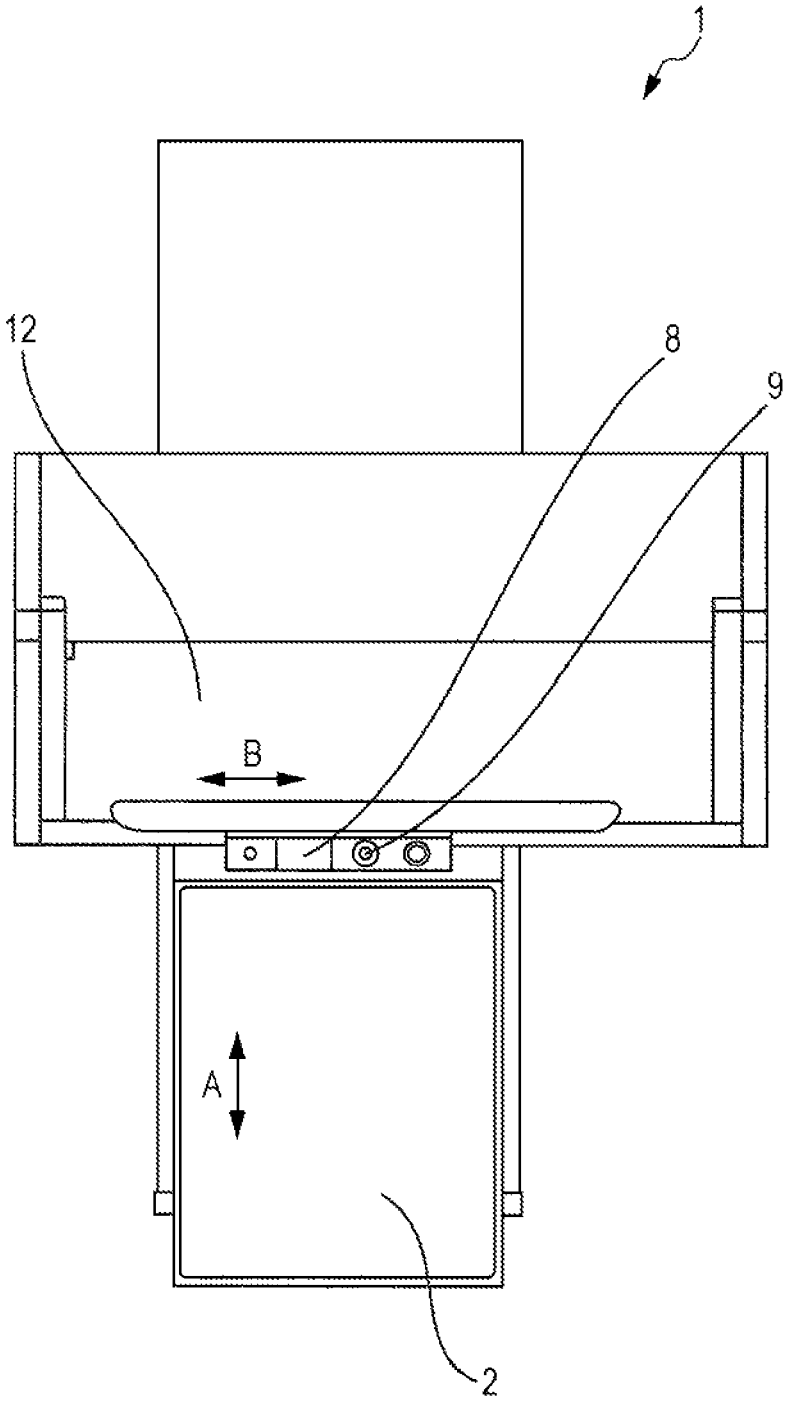
FIG. 3 is a schematic plan view illustrating the state where the medium support tray is in the set position of the recording medium in the recording apparatus according to the embodiment of the invention.
Figure 4:
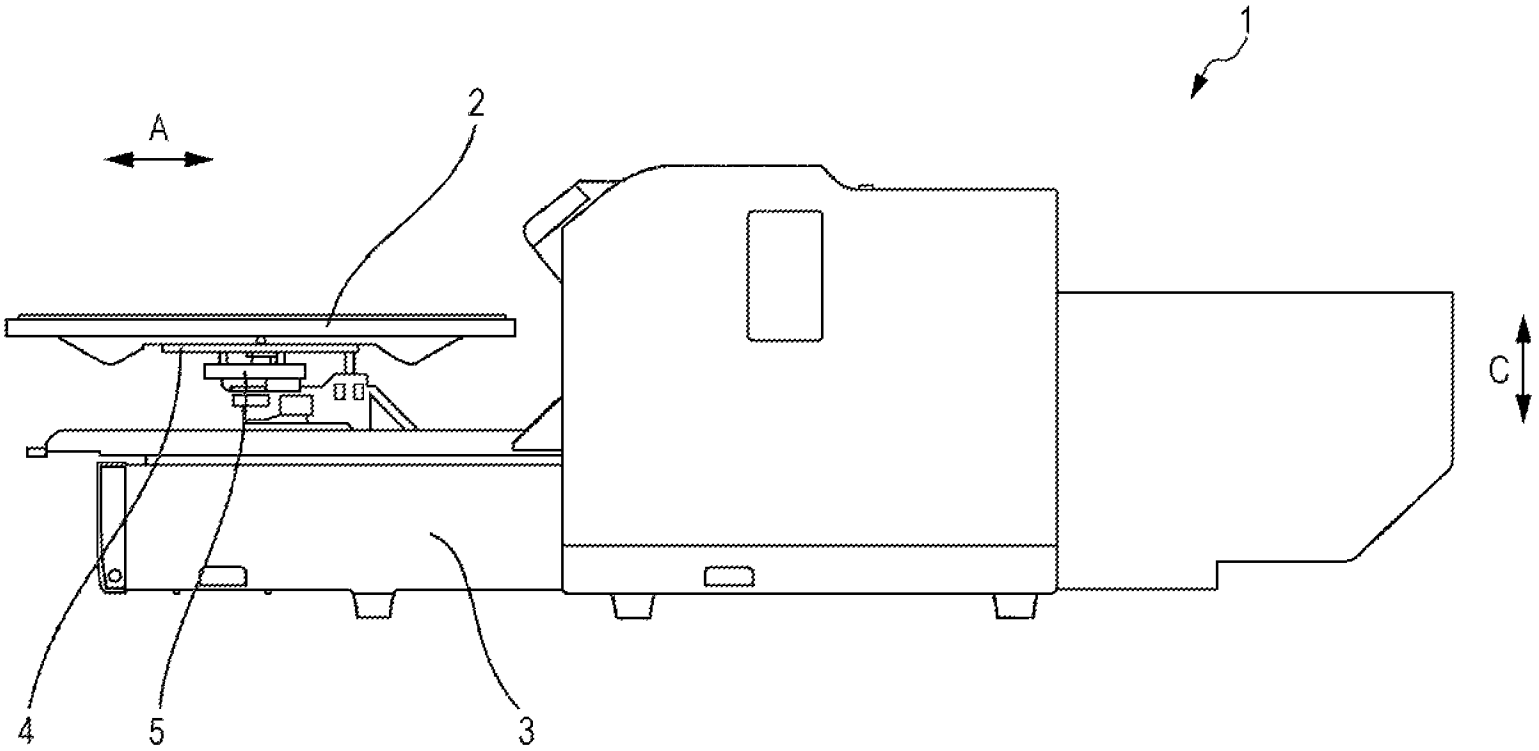
FIG. 4 is a schematic side view illustrating the state where the medium support tray is in the set position of the recording medium in the recording apparatus according to the embodiment of the invention.

FIG. 1 is a schematic perspective view, FIG. 2 is a schematic front view, FIG. 3 is a schematic plan view, and FIG. 4 is a schematic side view of a recording apparatus 1 according to the embodiment of the invention. FIGS. 1 to 4 all illustrate a state where a medium support tray is in a set position in which a recording medium is set.

The recording apparatus 1 of the embodiment includes a medium transportation section 3 (a moving mechanism of a medium support tray 2) transporting the recording medium supported on the medium support tray 2 capable of supporting the recording medium in a transportation direction A. The medium support tray 2 is placed on a stage 4. The medium support tray 2 is moved with the stage 4 in a height direction C by rotating a rotation lever 5.

A recording head 6 (see FIG. 6) as a recording section is included in a main body of the recording apparatus 1. The recording apparatus 1 of the embodiment forms a desired image by ejecting ink from the recording head 6 to the recording medium which is transported by being supported on the medium support tray 2 while reciprocating the recording head through a carriage 7 configuring a recording head moving mechanism in a scanning direction B intersecting the transportation direction A. In the recording apparatus 1 of the embodiment, a front side (lower left direction) in FIG. 1 is a set position of the recording medium on the medium support tray 2. The recording is performed while moving the medium support tray 2 to the front side in FIG. 1, after the medium support tray 2 on which the recording medium is set is moved to a recording start position of a back side (upper right direction) in FIG. 1.

The recording apparatus 1 has a monitor 8 and a control panel 9. A user selects a desired menu from menus displayed on the monitor 8 using the control panel 9 and can perform the menu in the recording apparatus 1. For example, the user can select a menu from the menus displayed on the monitor 8 to perform exchange of a wiper 10 (see FIG. 10) that is a protective member for maintaining a function of the recording head 6 using the control panel 9 and can perform a sequence thereof in the recording apparatus 1. The user can select a menu performing cleaning of a cap 11 (see FIG. 10) that is the protective member for maintaining the function of the recording head 6 and can perform a sequence thereof in the recording apparatus 1. Furthermore, it is possible to display on the monitor 8 an instruction or the like to the user when performing the sequence thereof.

In the recording apparatus 1 of the embodiment, a practical work of the exchange of the wiper 10 or cleaning of the cap 11 is performed manually by using a dedicated maintenance kit after the user opens a main body cover 12 during a series of a maintenance sequence.

Next, a state where the medium support tray is retracted from the set position of recording medium, when performing the maintenance of the protective member will be described.

Figure 5:
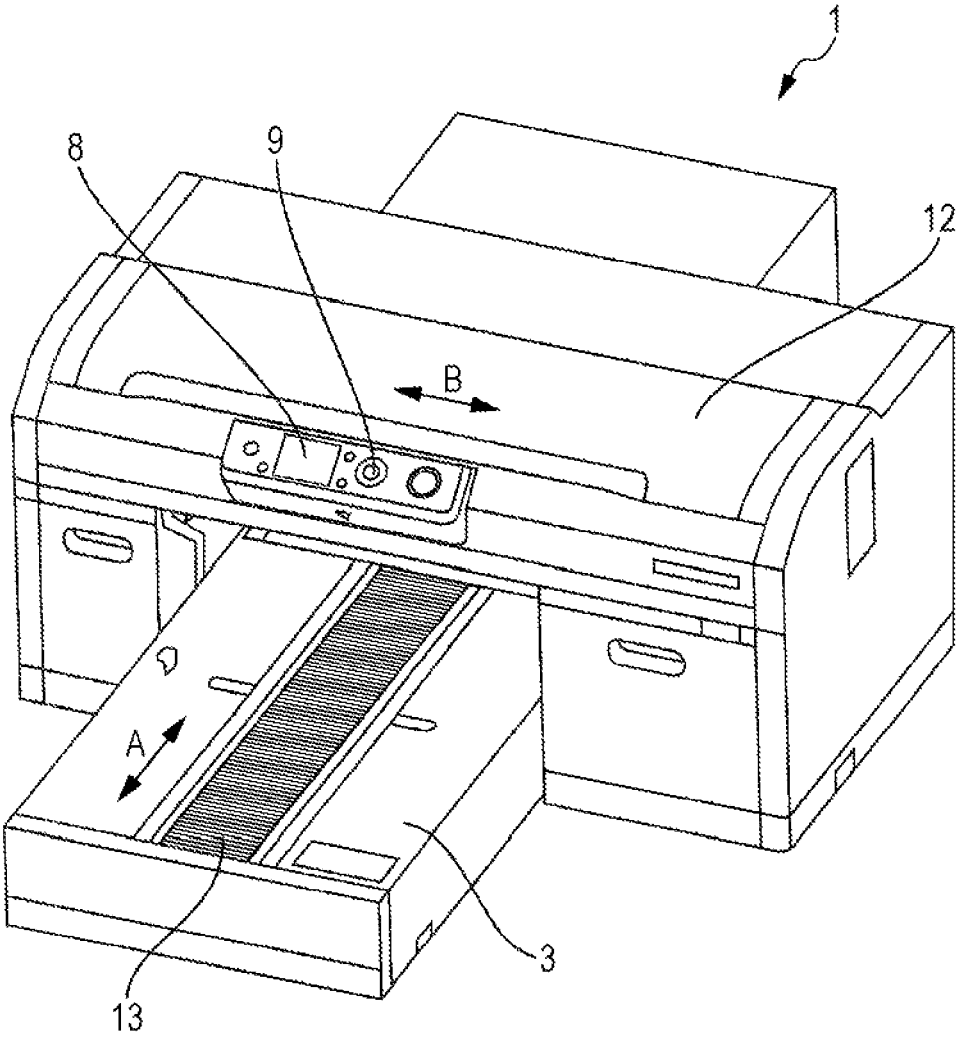
FIG. 5 is a schematic perspective view illustrating a state where the medium support tray is retracted from the set position of the recording medium in the recording apparatus according to the embodiment of the invention.
Figure 6:
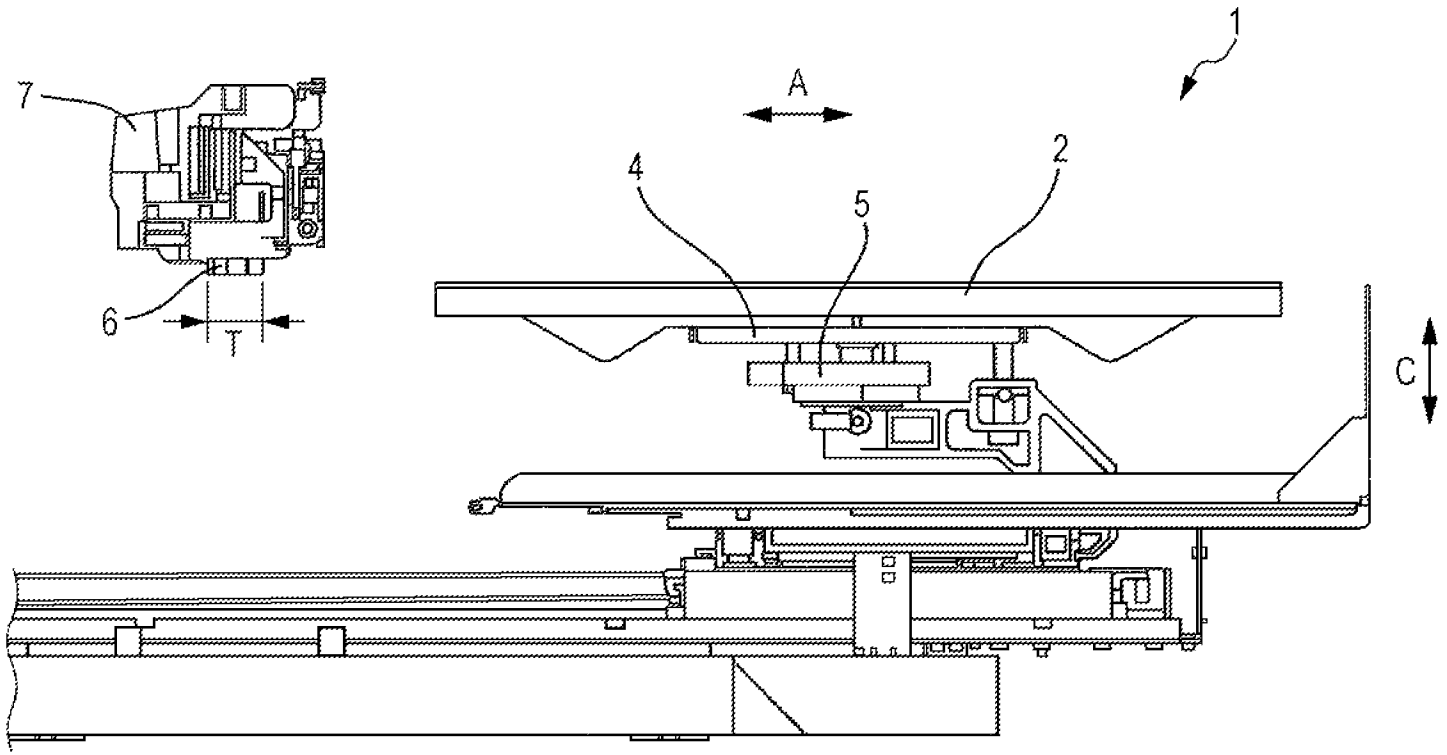
FIG. 6 is a schematic side view illustrating the state where the medium support tray is retracted from the set position of the recording medium in the recording apparatus according to the embodiment of the invention.

FIG. 5 is a schematic perspective view illustrating a state where the medium support tray of the recording apparatus 1 of the embodiment is retracted from the set position of the recording medium and FIG. 6 is a schematic side view illustrating a state where the medium support tray of the recording apparatus 1 of the embodiment is retracted from the set position of the recording medium.

As illustrated in FIGS. 5 and 6, in the recording apparatus 1 of the embodiment, the medium support tray 2 is retracted to the outside of a recordable area T of the recording head 6 when performing the maintenance of the wiper 10 and the cap 11. Thus, it is possible to suppress the recording head 6 from coming in contact with the medium support tray 2 or the recording medium supported on the medium support tray 2, or an ink from the recording head 6 from dropping onto the recording medium or the like.

The medium transportation section 3 as the moving mechanism of the medium support tray 2 of the recording apparatus 1 of the embodiment has a cover 13 of a bellow structure interlocking with the moving of the medium support tray 2. Thus, the cover 13 can protect the inside of the medium transportation section 3 even though the medium support tray 2 is moved to any position.

The recording apparatus 1 of the embodiment includes a controller 14 (see FIG. 11) which determines whether or not the recording medium is supported on the medium support tray 2. When the controller 14 determines that the recording medium is supported on the medium support tray 2, the medium support tray 2 is retracted from the set position of the recording medium to the recording start position.

FIG. 6 is a schematic side view illustrating a state where the medium support tray is retracted from the set position of the recording medium to the outside of the recordable area T of the recording head 6 when the controller 14 determines that the recording medium is not supported on the medium support tray 2.

Figure 7:
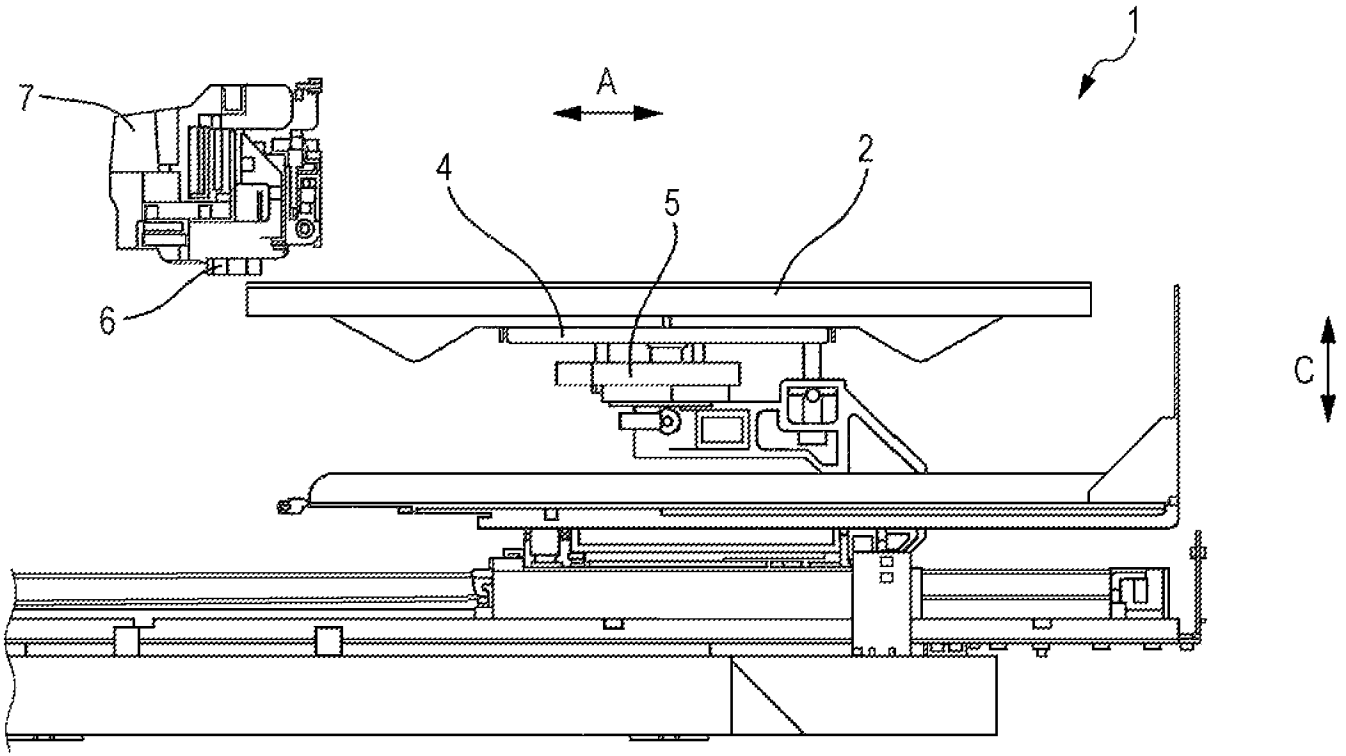
FIG. 7 is a schematic side view illustrating a state where the medium support tray is retracted from the set position of the recording medium to a recording start position in the recording apparatus according to the embodiment of the invention.

Meanwhile, FIG. 7 is a schematic side view illustrating a state where the medium support tray is retracted from the set position of the recording medium to the recording start position when the controller 14 determines that the recording medium is supported on the medium support tray 2.

As can be seen from comparison between FIGS. 6 and 7, in the recording apparatus 1, in a case where the controller 14 determines that the recording medium is not supported on the medium support tray 2, the medium support tray 2 is retracted to a position far from the set position of the recording medium than a case where the controller 14 determines that the recording medium is supported on the medium support tray 2.

Such control is performed by the controller 14 because shortening of the time to the recording start has priority in a case where the recording medium is supported on the medium support tray 2 and reduction of contact or the like between the recording head 6 and the medium support tray 2 has priority in a case where the recording medium is not supported.

Next, the recording head moving mechanism moving the recording head 6 will be described.

Figure 8:
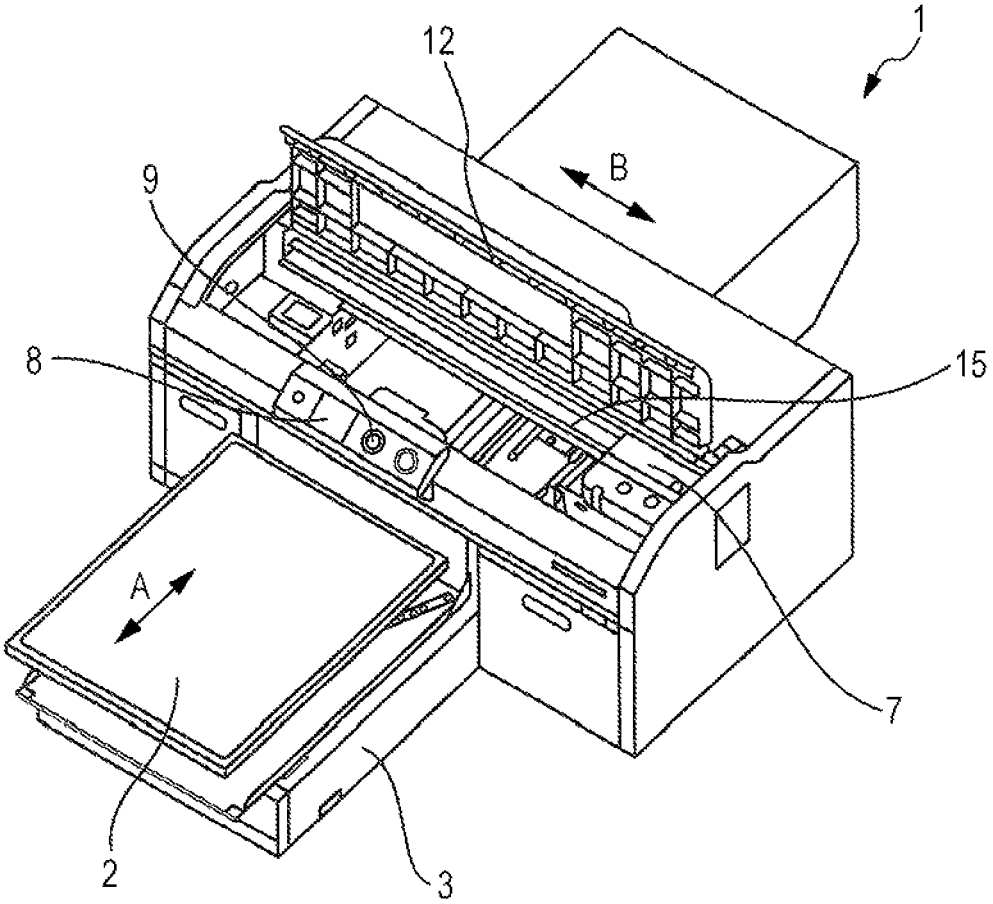
FIG. 8 is a schematic perspective view illustrating a state where a main body cover is open in the recording apparatus according to the embodiment of the invention.

FIG. 8 is a schematic perspective view illustrating a state where the main body cover 12 is open in the recording apparatus 1 of the embodiment.

In the recording apparatus 1 of the embodiment, the recording head moving mechanism includes the carriage 7 having the recording head 6 as a configuration component thereof. The recording head moving mechanism has a belt 15 on which the carriage 7 is mounted and which allows the recording head 6 to reciprocate and scan through the carriage 7 in the scanning direction B intersecting the transportation direction A. Furthermore, the recording head moving mechanism has a carriage motor 16 (see FIG. 11) engaging with the belt 15 and moving the carriage 7 through the belt 15.

Next, a protective member for maintaining a function of the recording head 6 will be described.

Figure 9:
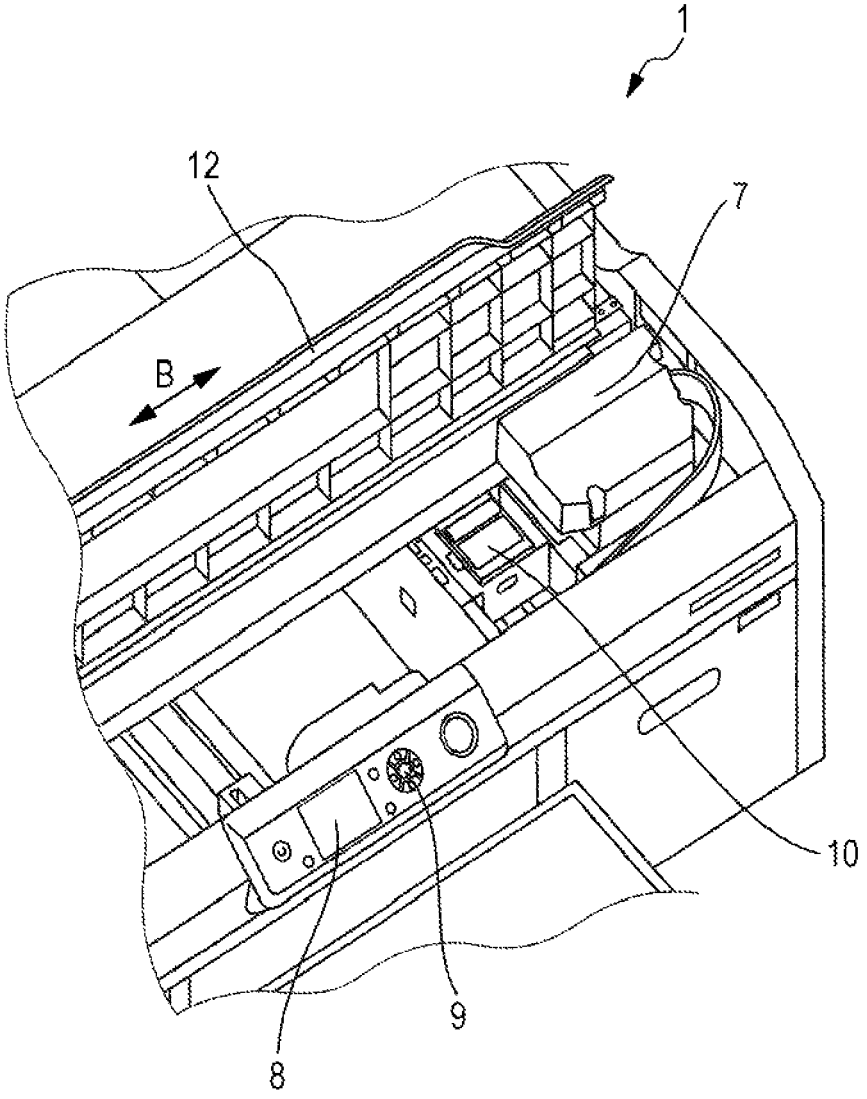
FIG. 9 is a schematic perspective view illustrating a state where a recording head is in a home position in the recording apparatus according to the embodiment of the invention.
Figure 10:
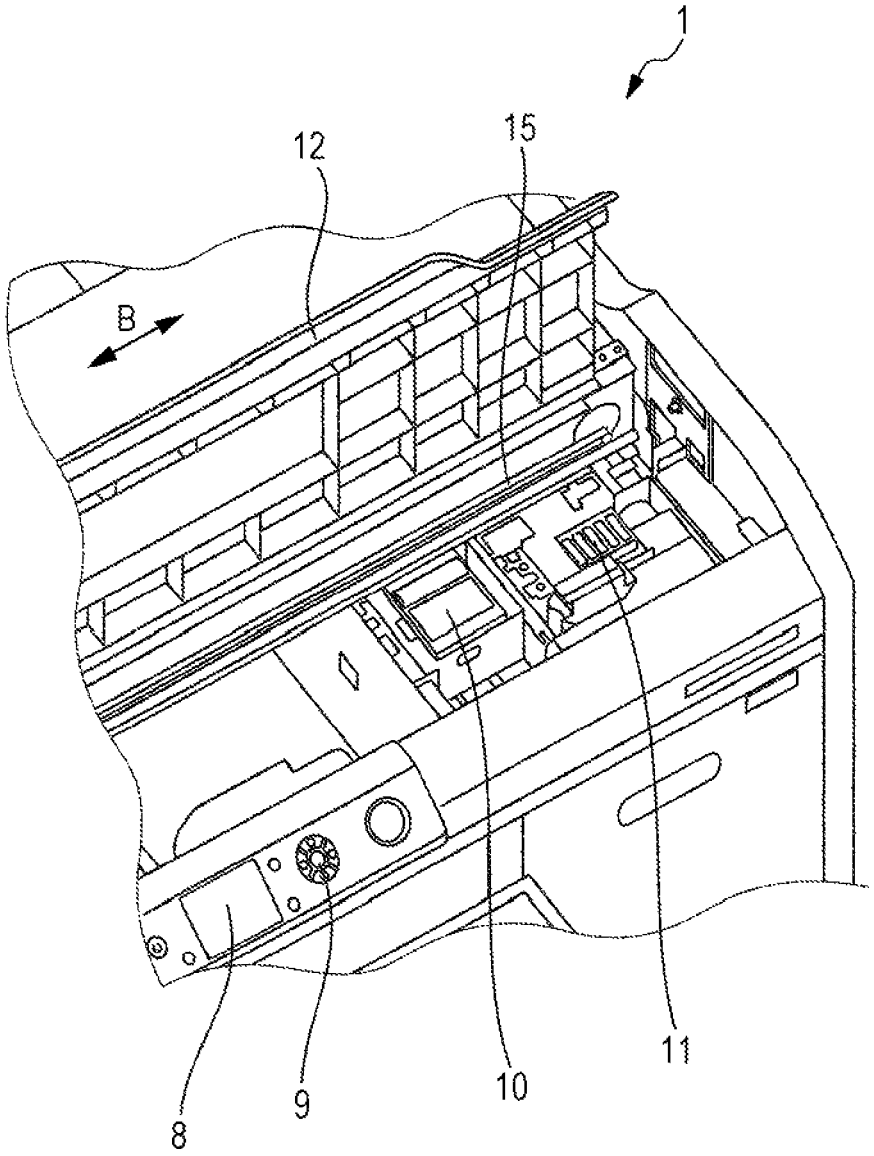
FIG. 10 is a schematic perspective view illustrating a state where the recording head is moved from the home position in the recording apparatus according to the embodiment of the invention.

FIG. 9 is a schematic perspective view illustrating a state where the recording head 6 is in a home position in the recording apparatus 1 of the embodiment and FIG. 10 is a schematic perspective view illustrating a state where the recording head 6 is moved from the home position in the recording apparatus 1 of the embodiment.

The protective member in the recording apparatus 1 of the embodiment has the wiper 10 and the cap 11.

The wiper 10 of the embodiment is made of cloth and the recording apparatus 1 of the embodiment has a configuration capable of cleaning an ink ejection surface by wiping the ink ejection surface of the recording head 6 by pressing the wiper 10 thereon. The wiper 10 of the embodiment is required to be exchanged periodically. Thus, the recording apparatus 1 of the embodiment has a wiper exchange sequence as the maintenance sequence of the protective member of the recording head.

The cap 11 is configured of an elastic member and has a configuration capable of covering a column (a nozzle column) of an ink ejection port of the recording head 6 for each color. The cap 11 has a role to suppress the ink of the ink ejection port from drying and adhering by covering the nozzle column. The cap 11 is connected to a suction pump (not illustrated) and also has a role to suck and discharge the adhered ink when the ink of the ink ejection port is adhered. Since the cap 11 of the embodiment is contaminated by adhering of the ink in accordance with the use of the recording apparatus 1, the user is required to perform the cleaning manually. Thus, the recording apparatus 1 of the embodiment has a cap cleaning sequence as the maintenance sequence of the protective member of the recording head.

The recording apparatus 1 of the embodiment includes the wiper 10 and the cap 11 on the home position side of the recording head 6 in the scanning direction B. In other words, a target area of the maintenance is on the home position side. Since the recording apparatus having such a configuration performs a protection operation for maintaining the function of the recording head on the home position side, it is possible to shorten the moving time of the recording head. Thus, it is possible to shorten the time for the protection operation and the above configuration is preferred; however, the invention is not limited to the configuration described above.

Next, an electrical configuration in the recording apparatus 1 of the embodiment will be described.

Figure 11:
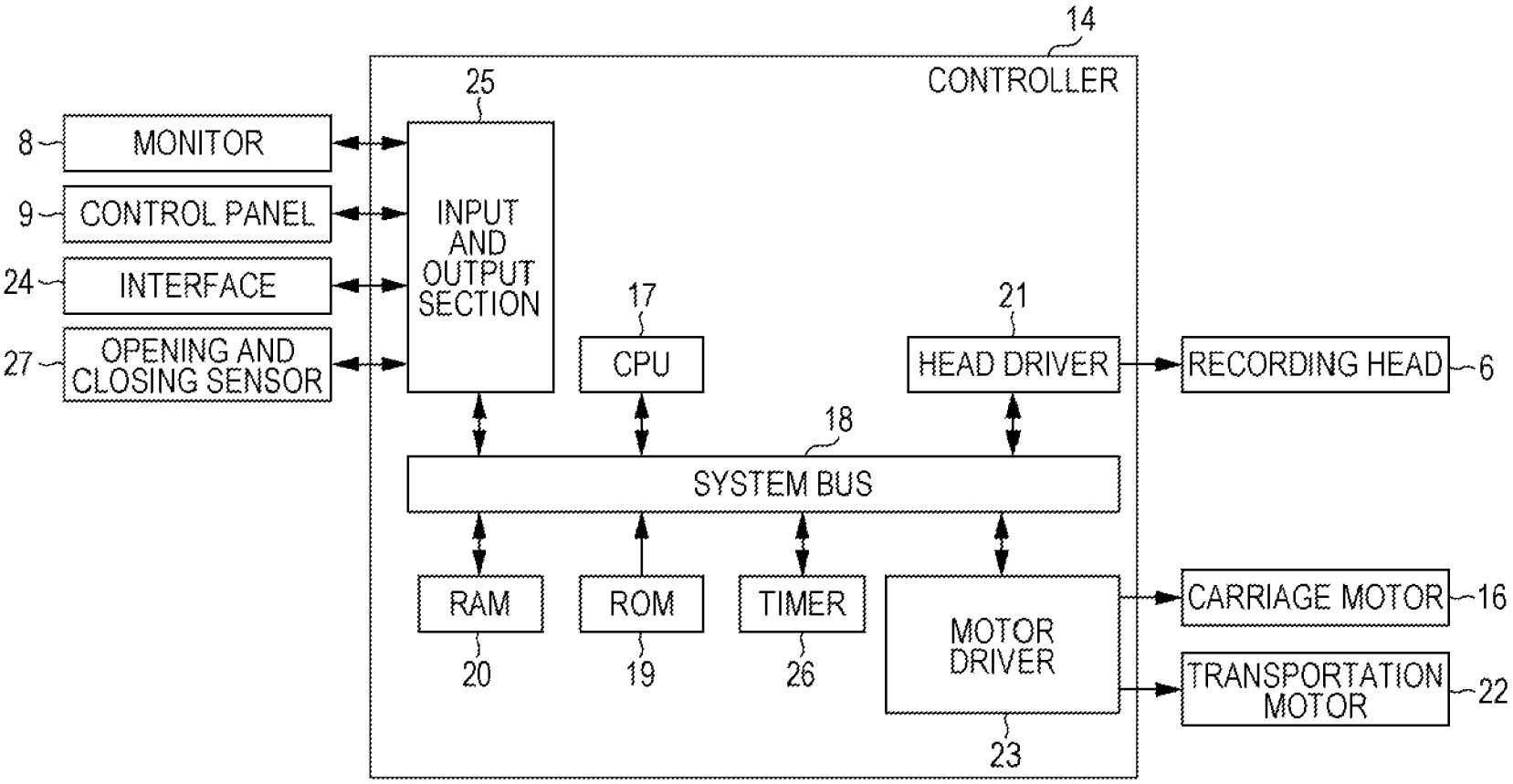
FIG. 11 is a block diagram of the recording apparatus according to the embodiment of the invention.

FIG. 11 is a block diagram of the recording apparatus 1 of the embodiment.

The controller 14 has a CPU 17 for controlling the entire recording apparatus 1. The CPU 17 is connected through a system bus 18 to a ROM 19 storing various control programs, the maintenance sequence or the like which are performed by the CPU 17 and a RAM 20 capable of storing data temporarily. The CPU 17 is connected to a head driver 21 for driving the recording head 6 through the system bus 18. The CPU 17 is connected to a motor driver 23 for driving a carriage motor 16 for moving the carriage 7 and a transportation motor 22 for transporting the recording medium. The CPU 17 is connected to an input and output section 25 which performs receiving the data and signals from and transmitting the data and signals to an interface 24, the monitor 8 and the control panel 9 for inputting recording data or the like from an outer apparatus such as a PC.

The controller 14 has a role as a receiving section of an instruction of the maintenance start for receiving the instruction of the maintenance start of the protective member such as the wiper exchange sequence or the cap cleaning sequence which is instructed by the user to perform through the control panel 9. The control of the medium transportation section 3 is performed in response to the receiving of the instruction of the maintenance start so that the medium support tray 2 is retracted from the set position when setting the recording medium on the medium support tray 2. It is possible to suppress the medium support tray 2 from being an obstacle and efficiency of the maintenance work from being lowered by performing such control, when performing the maintenance of the wiper 10 and the cap 11.

The controller 14 includes a timer 26, measures an elapsed time after the cap cleaning sequence is performed, and is configured to display on the monitor 8 for prompting the performance of the cap cleaning sequence when the measured time exceeds a predetermined time.

The controller 14 controls the recording head moving mechanism so as to move the recording head 6 from the target area of the maintenance following retraction of the medium support tray 2 by the medium transportation section 3. That is, retraction of the medium support tray 2 is completed when moving the recording head 6. Thus, it is possible to suppress the recording head 6 from coming in contact with the medium support tray 2 or the recording medium supported on the medium support tray 2, or the ink from the recording head 6 from dropping on the recording medium.

The controller 14 determines whether or not the recording medium is supported on the medium support tray 2 and when it is determined that the recording medium is supported, the controller 14 controls the medium transportation section 3 so as to retract the medium support tray 2 from the set position of the recording medium to the recording start position. It is possible to start the recording immediately after the maintenance is completed by performing such control. On the other hand, when it is determined that the recording medium is not supported, the controller 14 controls the medium transportation section 3 so as to retract the medium support tray 2 from the set position of the recording medium to the outside of the recordable area T of the recording head 6. It is possible to set the recording medium and start the recording immediately after the maintenance is completed by performing such control.

Furthermore, the controller 14 has a role as a receiving section of the instruction of the maintenance completion for receiving the instruction of the maintenance completion of the protective member such as the wiper exchange sequence or the cap cleaning sequence. The presence or absence of the instruction of the recording and whether or not the recording medium is supported on the medium support tray 2 are determined in response to the receiving of the instruction of the maintenance completion. When it is determined that the instruction of the recording is present and the recording medium is supported on the medium support tray 2, the controller 14 controls the recording apparatus 1 so as to start the recording. On the other hand, when it is determined that the instruction of the recording is present and the recording medium is not supported on the medium support tray 2, the controller 14 controls the medium transportation section 3 so as to move the medium support tray to the set position. Thus, in a case where it is determined that the instruction of the recording is present, it is possible to start the recording with the recording apparatus immediately after the maintenance is completed, when it is determined that the recording medium is supported. In a case where it is determined that the instruction of the recording is present, it is possible to set the recording medium on the medium support tray 2 immediately after the maintenance is completed and it is possible to start the recording with the recording apparatus immediately thereafter, when it is determined that the recording medium is not supported.

In the recording apparatus 1 of the embodiment, when the controller 14 determines that the instruction of the recording is absent, the medium support tray 2 is not moved.

Figure 12:
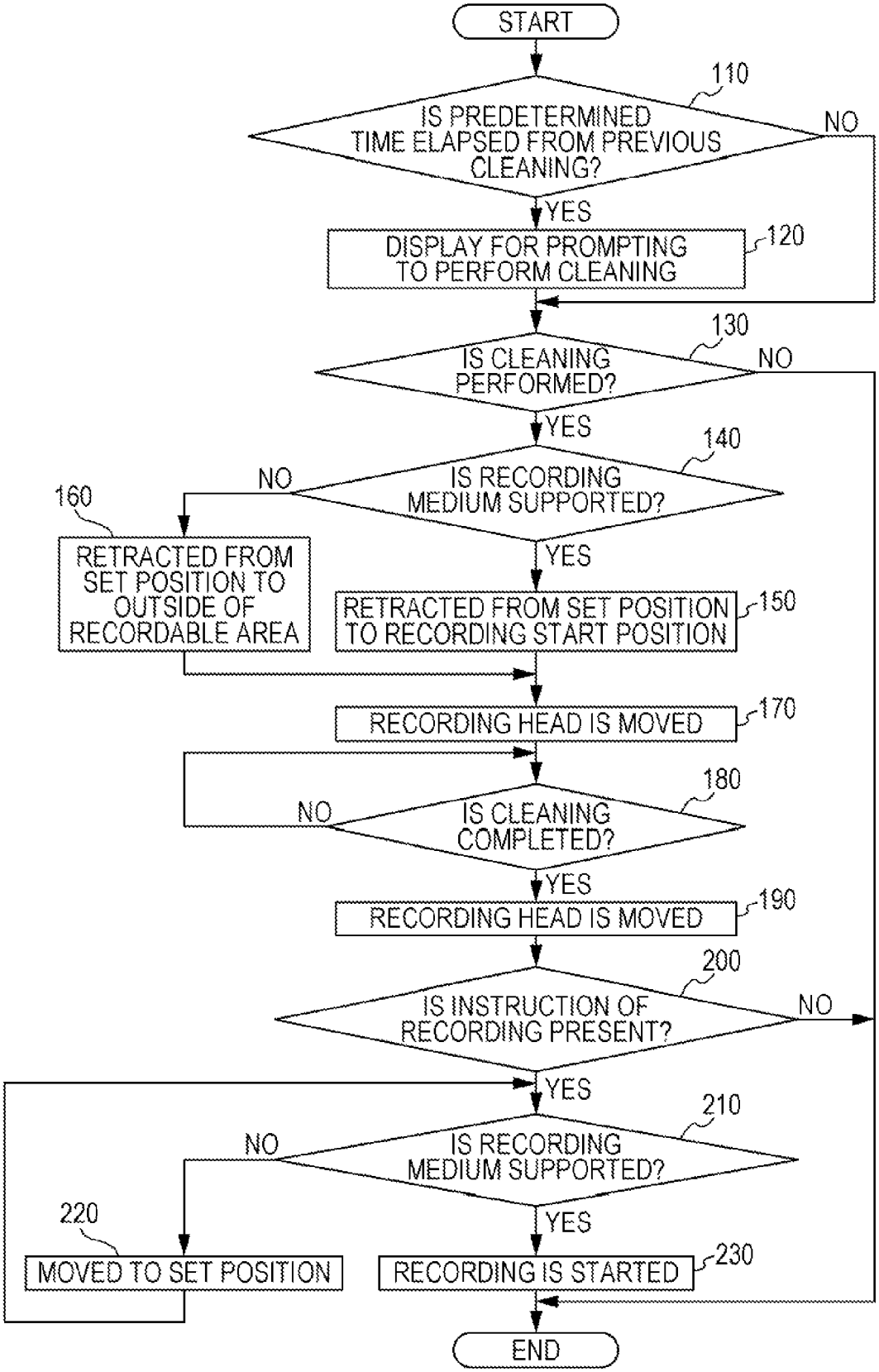
FIG. 12 is a flowchart according to an embodiment of a maintenance method and a recording method of the invention.

Embodiment of Maintenance Method and Recording Method (FIG. 12)

Next, an embodiment of a maintenance method and a recording method of the invention will be described.

FIG. 12 is a flowchart according to an embodiment of the maintenance method and the recording method of the invention.

The maintenance method and the recording method of the embodiment is an embodiment which is performed by using the recording apparatus 1 described above, and is an embodiment of the maintenance method and the recording method when performing the cap cleaning sequence as the maintenance sequence.

The recording apparatus 1 used in the maintenance method and the recording method of the embodiment includes the timer 26 in the controller 14, and the controller 14 measures an elapsed time after the cap cleaning sequence is performed.

In the maintenance method and the recording method of the embodiment, initially, in step S110, the controller 14 determines whether or not a predetermined time as a threshold value is elapsed from the previous cleaning.

When the predetermined time is elapsed, in step S120, a display for prompting the user to perform the cleaning of the cap 11 is performed on the monitor 8 and then the process proceeds to step S130.

On the other hand, when the predetermined time is not elapsed, the process proceeds to step S130 as it is.

Next, in step S130, the controller 14 determines whether or not the cleaning is performed. In the embodiment, specifically, it is determined whether or not the controller 14 receives the instruction of the maintenance start to perform the cap cleaning sequence which is performed by the user through the control panel 9.

When the controller 14 receives the instruction of the maintenance start and determines that the cleaning is performed, the process proceeds to step S140.

On the other hand, when the controller 14 does not receive the instruction of the maintenance start and determines that the cleaning is not performed, the maintenance method and the recording method of the embodiment are finished.

Next, in step S140, the controller 14 determines whether or not the recording medium is supported on the medium support tray 2. In the embodiment, specifically, the display for the user confirming whether or not the recording medium is supported is performed on the monitor 8, the user selects whether or not the recording medium is supported through the control panel 9, and the controller 14 determines whether or not the recording medium is supported by inputting a result thereof.

When the controller 14 determines that the recording medium is supported on the medium support tray 2, the process proceeds to step S150 and the medium support tray 2 is retracted from the set position of the recording medium indicated in FIGS. 1 to 4 to the recording start position indicated in FIG. 7 by control of the controller 14.

On the other hand, when the controller 14 determines that the recording medium is not supported on the medium support tray 2, the process proceeds to step S160 and the medium support tray 2 is retracted from the set position of the recording medium to the position (the outside of the recordable area) indicated in FIG. 6 by control of the controller 14.

Next, in step S170, the recording head 6 is moved from the home position (the target area of the maintenance) by control of the controller 14 so that the user can perform the cap cleaning work manually. When the user opens the main body cover 12, performs cap cleaning work manually and then closes the main body cover 12, the controller 14 determines that the main body cover 12 is closed through an opening and closing sensor 27.

Thus, the controller 14 determines that the cleaning work is completed in step S180 by determining that the main body cover 12 is closed. In other words, the controller 14 receives the instruction of the maintenance completion by determining that the main body cover 12 is closed. After completion of the cap cleaning work, the user can transmit a signal indicating the cleaning completion through the control panel 9 and the controller 14 can receive the signal.

When the controller 14 determines that the cleaning work is completed in step S180, the process proceeds to step S190 and the recording head 6 is moved to the home position by control of the controller 14.

Next, in step S200, the controller 14 determines whether or not the instruction of the recording is present. In the embodiment, specifically, the controller 14 determines whether or not the recording data is input from an external apparatus such as a PC through the interface 24.

In step S200, when the controller 14 determines that the instruction of the recording is present, the process proceeds to step S210. In step S210, the state of whether or not the recording medium is supported is determined. In step S210, a specific determination method of whether or not the recording medium is supported is the same as that in step S140. In step S210, when it is determined that the recording medium is not supported, the process proceeds to step S220 and the medium support tray 2 is moved to the set position of recording medium and then the process returns to step S210 to determine whether or not the recording medium is supported again. In step S210, when it is determined that the recording medium is supported, the controller 14 controls the recording apparatus 1 and then the recording is started in step S230. The maintenance method and the recording method of the embodiment are finished with the completion of the recording.

On the other hand, in step S200, when the controller 14 determines that the instruction of the recording is not present, the maintenance method and the recording method of the embodiment are finished while the medium support tray 2 is retracted from the set position. In step S200, when the controller 14 determines that the instruction of the recording is not present, the medium support tray 2 may be returned to the set position rather than the medium support tray 2 is retracted from the set position.

The recording apparatus 1 of the embodiment is the recording apparatus having the configuration in which the medium support tray 2 is moved (the recording medium supported on the medium support tray 2 is transported) with respect to the recording head 6. However, the recording apparatus 1 of the invention may be a flatbed type recording apparatus having a configuration in which the recording head 6 is moved with respect to the medium support tray 2 or a recording apparatus having a configuration in which both are relatively moved.

What is claimed is:

1. A recording apparatus comprising:

a medium support tray that is capable of supporting a recording medium;

a recording head that is capable of recording on the recording medium;

a protective member for maintaining a function of the recording head; and a controller that determines whether or not the recording medium is supported on the medium support tray, when the controller received an instruction of a maintenance that starts a maintenance sequence for the protective member.

2. The recording apparatus according to claim 1, wherein the controller determines whether or not the recording medium is supported on the medium support tray, based on an input by a user.

3. The recording apparatus according to claim 1, wherein the controller determines whether or not the recording medium is supported on the medium support tray, when the maintenance sequence is completed.

4. The recording apparatus according to claim 1, wherein the controller promotes a user to perform the maintenance sequence, when a predetermined time is elapsed from a previous maintenance sequence.

5. The recording apparatus according to claim 1, wherein the protective member includes a wiper that is capable of wiping an ink ejection surface of the recording head, and the maintenance sequence includes a sequence that exchanges the wiper.

6. The recording apparatus according to claim 1, wherein the protective member includes a cap that is capable of covering an ink ejection port of the recording head, and the maintenance sequence includes a sequence that cleans the cap.

* * * * *